US008171581B2

(12) United States Patent
Agarwall

(10) Patent No.: US 8,171,581 B2
(45) Date of Patent: May 8, 2012

(54) FITTED BED SHEET

(75) Inventor: Arun Agarwall, Dallas, TX (US)

(73) Assignee: Alok International Inc., Dallas, TX (US)

( * ) Notice: Subject to any disclaimer, the term of this patent is extended or adjusted under 35 U.S.C. 154(b) by 0 days.

(21) Appl. No.: 13/023,970

(22) Filed: Feb. 9, 2011

(65) Prior Publication Data

US 2012/0054962 A1 Mar. 8, 2012

Related U.S. Application Data

(60) Provisional application No. 61/379,849, filed on Sep. 3, 2010.

(51) Int. Cl.
*A47G 9/02* (2006.01)

(52) U.S. Cl. ..... 5/497; 5/482; 5/486

(58) Field of Classification Search ..... 5/494–498, 5/485, 486, 482, 922, 923
See application file for complete search history.

(56) References Cited

U.S. PATENT DOCUMENTS

| | | | | |
|---|---|---|---|---|
| 2,624,893 | A | 11/1949 | Harris | |
| 4,672,702 | A | 6/1987 | Isham | |
| 4,980,941 | A * | 1/1991 | Johnson, III | 5/497 |
| 5,029,353 | A | 7/1991 | Kimball et al. | |
| 2005/0028278 | A1 * | 2/2005 | Landry | 5/494 |
| 2007/0056100 | A1 | 3/2007 | Stewart | |
| 2008/0263768 | A1 | 10/2008 | Balasundharam | |

OTHER PUBLICATIONS

International Search Report for PCT/US2011/045317 dated Oct. 6, 2011. (4 pages).

* cited by examiner

*Primary Examiner* — Fredrick Conley
(74) *Attorney, Agent, or Firm* — Rader, Fishman & Grauer PLLC

(57) ABSTRACT

A fitted sheet configured to contour to mattresses of different thickness. The fitted sheet has a top panel and a plurality of side panels extending from the top panel. The fitted sheet further includes at least one stretchable portion secured to at least one end of the side panels wherein the stretchable portions are mated together and configured to extend around at least one corner of the mattress. Accordingly, the fitted sheet may be easier to apply and remove from the mattress and may be easier to fold and store during nonuse.

20 Claims, 7 Drawing Sheets

FITTED BED SHEET

RELATED APPLICATIONS

This application claims priority under 35 U.S.C. §119(e) to U.S. Provisional Application No. 61/379,849 filed Sep. 3, 2010. The foregoing application is incorporated by reference herein in its entirety.

FIELD

The present disclosure is related to forms of bedding including sheets, blankets, and mattress covers. In particular, the present disclosure is related to fitted bed sheets configured to conform to the contours of a mattress.

BACKGROUND

Fitted sheets, sometimes referred to as bottom sheets, are a type of linen used to cover a mattress. A fitted sheet generally comprises a top panel and several side panels. The top panel is designed to cover the top surface of the mattress and the side panels extend from the top panel to cover the sides of the mattress. Typically, adjacent side panels are joined together forming a unitary sheet adapted to conform to the shape of a particular mattress.

Although fitted sheets may include an elastic band or other arrangements for securing the fitted sheet to a mattress, fitted sheets often become displaced when the bed is being used. Accordingly, there is a need for a fitted sheet capable of remaining in place during normal use.

Moreover, while most mattress sizes (e.g. king, queen, full) have a standard width and length, the thickness of a particular mattress size may vary based on the type of bed and/or the manufacturer of the bed. As a result, a fitted sheet adapted to conform to the shape of a particular mattress size may not fit all mattresses of that size. Therefore, there is also a need for a fitted sheet configured to conform to mattresses of varying thickness.

DETAILED DESCRIPTION

Figure 1:
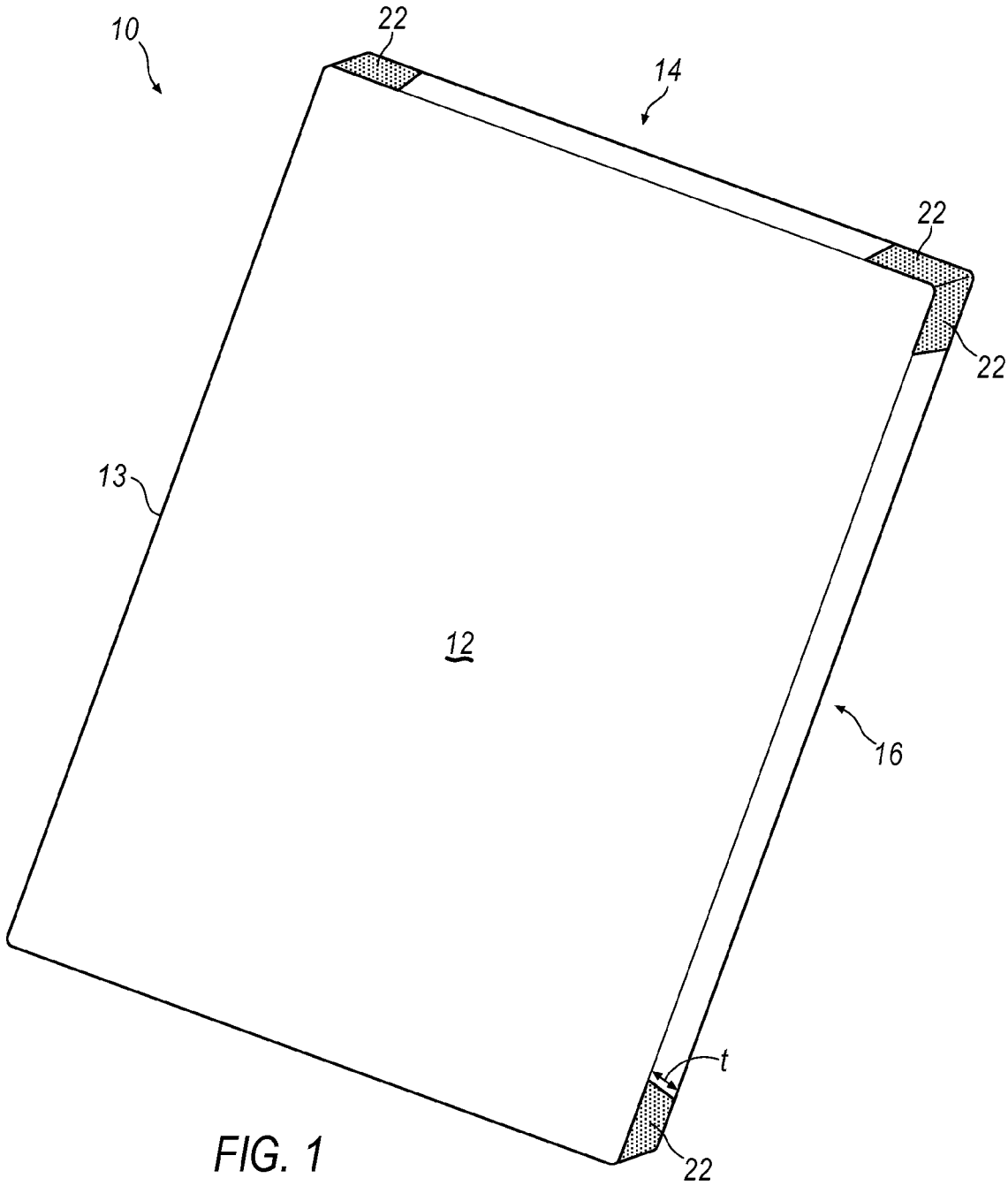
FIG. 1 is an exemplary fitted sheet.

Referring now to the discussion that follows and also to the drawings, illustrative approaches are shown in detail. Although the drawings represent some possible approaches, the drawings are not necessarily to scale and certain features may be exaggerated, removed, or partially sectioned to better illustrate and explain the present disclosure. Further, the descriptions set forth herein are not intended to be exhaustive or otherwise limit or restrict the claims to the precise forms and configurations shown in the drawings and disclosed in the following detailed description.

FIG. 1 illustrates an exemplary fitted sheet 10 configured to conform to the contours of a mattress and capable of maintaining the fit of the sheet with respect to the mattress during use. The fitted sheet 10 may take many different forms and include multiple and/or alternate components. While an exemplary fitted sheet is shown in FIG. 1, the exemplary components illustrated in the figure are not intended to be limiting. Indeed, additional or alternative components and/or implementations may be used.

Figure 2:
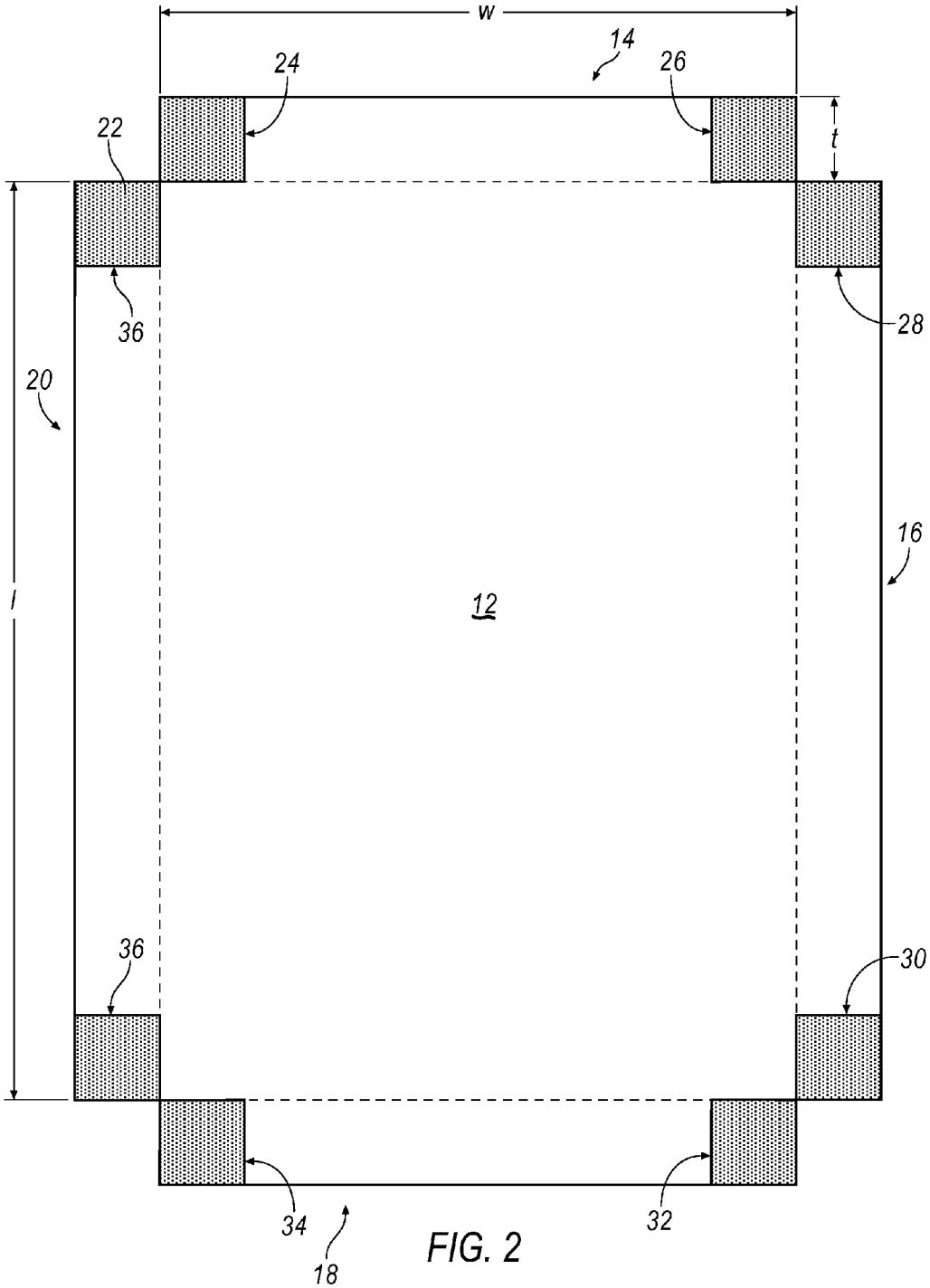
FIG. 2 is a top view of the exemplary fitted sheet illustrated in FIG. 1 prior to formation of the sheet.

FIG. 2 illustrates a top view of the exemplary fitted sheet 10 illustrated in FIG. 1 prior to formation of the sheet. The fitted sheet 10 may include a top panel 12 and a plurality of side panels, including a first side panel 14, a second side panel 16, a third side panel 18, and a fourth side panel 20. The top panel 12 and the plurality of side panels 14, 16, 18, 20 may be formed from a single piece of material. Such materials may include, but are not limited to, cotton, silk, rayon or any combination thereof. The top panel 12 and the plurality of side panels 14, 16, 18, 20 may also be formed from separate materials joined together using any suitable method including sewing and gluing.

The plurality of side panels 14, 16, 18, 20 extend downwardly from a peripheral edge 13 of the top panel 12. The side panels 14, 16, 18, 20 may be configured to extend downwardly the thickness of a mattress. However, the adjacent side panels 14, 16, 18, 20 may also be configured to extend downwardly the thickness of the mattress and underneath the mattress. A bottom edge of one or more of the side panels 14, 16, 18, 20 may also include an elastic strip configured to maintain the sheet in its fitted position.

In the illustrated approach, opposing side panels 14, 18 extend along a first extent "w" representing a width dimension of the mattress while two opposing side panels 16, 20 extend along a second extent "l" representing a length dimension of the mattress. Generally, the first side panel 14 and the third side panel 18 are substantially congruent and the second side panel 16 and the fourth side panel 18 are substantially congruent. However, the dimensions of the opposing side panels may take on various sizes based on mattress design and contours.

As illustrated, the side panels 14, 16, 18, 20 may further include at least one stretchable portion 22 configured to maintain the sheet in its fitted position during use. The stretchable portion 22 may be formed of any suitable elastic-type material including LYCRA® fabric, spandex yarn, cotton yarn, a LYCRA® infused cotton weave, or any combination thereof. The stretchable portion 22 may extend downwardly from the peripheral edge 13 of the top panel 12. The stretchable portion 22 may also be secured to the side panels 14, 16, 18, 20. For example, the stretchable portion 22 may be stitched to the top panel 12 and an end, edge or the corners of one or more of the plurality of side panels 14, 16, 18, 20 using any suitable means including, sewing, gluing and a five thread stitching technique. The five thread stitching technique uses multiple threads that are overlocked with each other to provide strength and flexibility to the area where the stitches are made. This allows the sheet to conform to the shape of the mattress and better maintain the position of the sheet on the mattress when in use. Moreover, configuring the stretchable portion 22 and the plurality of side panels 14, 16, 18, 20 to extend downwardly form the peripheral edge 13 of top panel 12 also provides for a smoother lying surface.

In the illustrated example, the stretchable portion 22 is secured to a first end and a second end of the side panels 14, 16, 18, 20. That is, the first side panel 14 has the stretchable portion 22 secured to both a first end 24 and a second end 26. Similarly, the second side panel 16 has the stretchable portion 22 secured to both a first end 28 and a second end 30, the third side panel 18 has a stretchable portion 22 secured to both a first end 32 and a second end 34, and a fourth side panel 20 has a stretchable portion 22 secured to both a first end 36 and a second end 38. As discussed above, the stretchable portions 22 may be secured to the edge or corners of the first end and second ends of the plurality of side panels using any suitable manner. Moreover, when the sheet is folded to form the fitted sheet 10 illustrated in FIG. 1 and discussed in more detail below, the stretchable portions 22 may be mated together using any suitable technique, including the five thread stitching technique. This exemplary approach allows the fitted sheet 10 to remain in place during normal use better than fitted sheets having a single stretchable portion.

Figure 3:
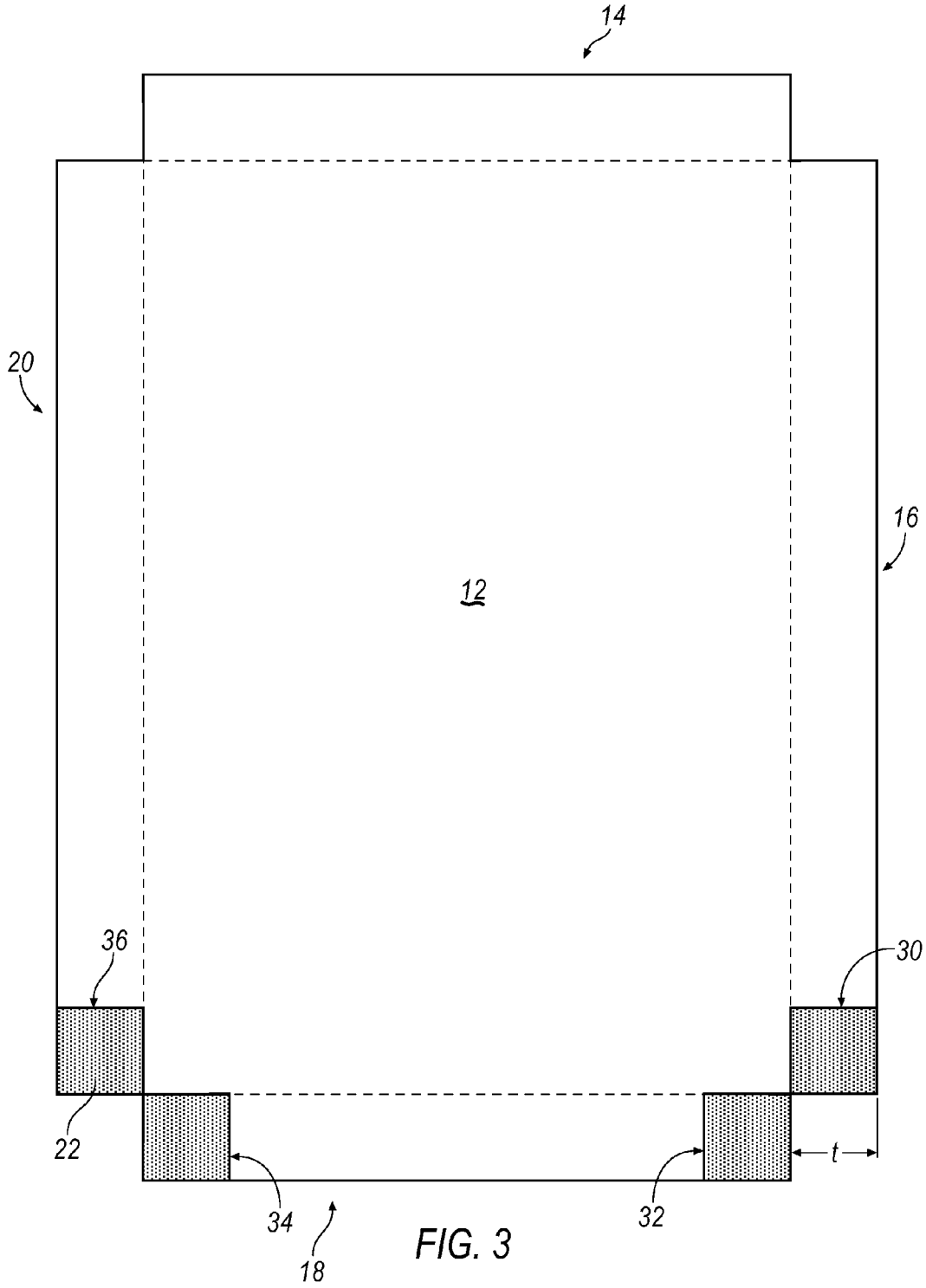
FIG. 3 is a top view of an exemplary fitted sheet prior to formation of the sheet.
Figure 4:
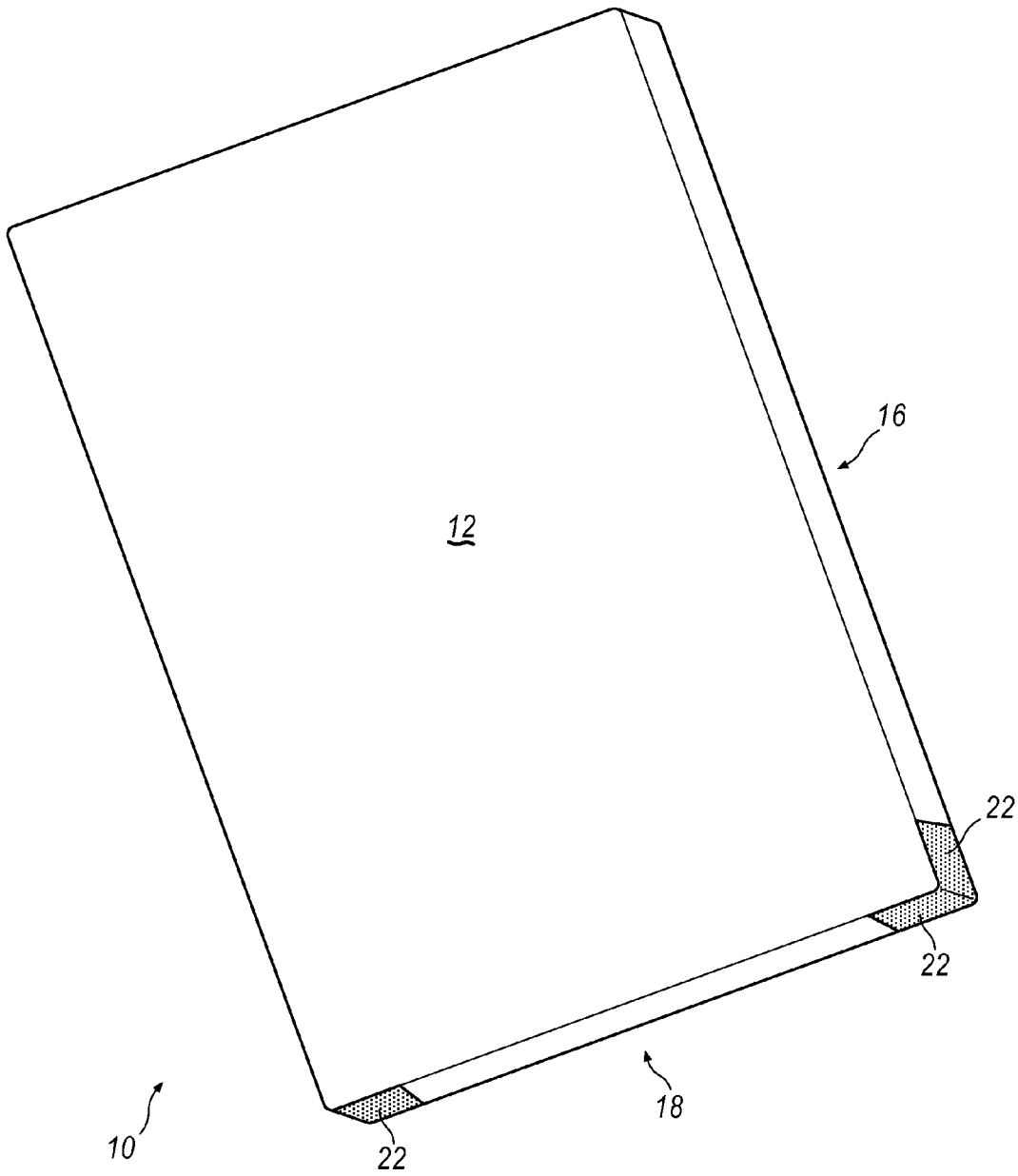
FIG. 4 is the exemplary fitted sheet illustrated in FIG. 3 after formation of the sheet.

Although FIG. 2 shows the plurality of side panels 14, 16, 18, 20 including stretchable portions 22 attached to each end, the number of stretchable portions 22 added to the plurality of side panels 14, 16, 18, 20 may vary based on the design of the fitted sheet and the type of mattress the fitted sheet is designed to contour. As an example, FIG. 3 illustrates a top view of another exemplary fitted sheet 10 prior to formation of the sheet. In the illustrated example, one stretchable portion 22 is secured to the second end 30 of the second side panel 18 and one stretchable portion 22 is secured to the first end 36 of the fourth side panel 20. The third side panel 18 includes a stretchable portion 22 secured to both the first end 32 and the second end 34 of the third side panel 18. Thus, when the sheet is folded to form the fitted sheet illustrated in FIG. 4, three of the side panels forming the fitted sheet 10 include corners formed by mating the stretchable portions 22.

Figure 5:
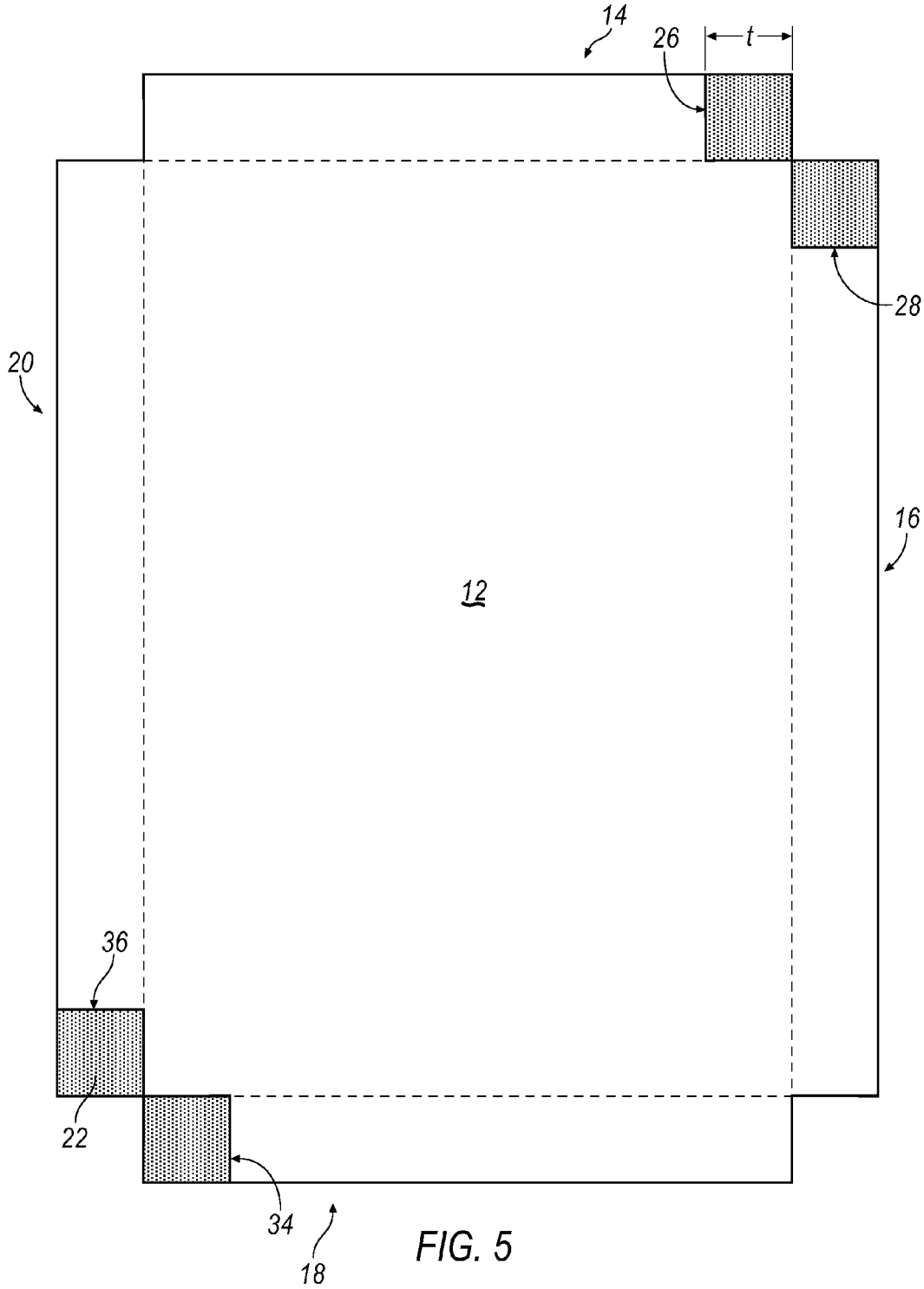
FIG. 5 is a top view of an exemplary fitted sheet.

In another illustrative example, shown in FIG. 5, the fitted sheet may include one stretchable portion secured to one end of each of the plurality of side panels 14, 16, 18, 20. As illustrated, the first side panel 14 has the stretchable portion 22 secured to the second end 26, the second side panel 16 has the stretchable portion 22 secured to the first end 28, the third side panel 18 has a stretchable portion 22 secured to the second end 34, and the fourth side panel 20 has a stretchable portion 22 secured to the first end 36. When the sheet is folded, the fitted sheet 10 is formed having diagonally opposing corners formed from the stretchable portions 22 that have been mated together.

In the exemplary approaches discussed above, each stretchable portion 22 is of the same general size and shape in a generally relaxed non-loaded state as represented by an extent "t", where t is generally the maximum expected thickness of a possible mattress. When the fitted sheet 10 is formed and the stretchable portions 22 are mated, the stretchable portions 22 are configured to conform to the corners of the mattress.

Figure 6:
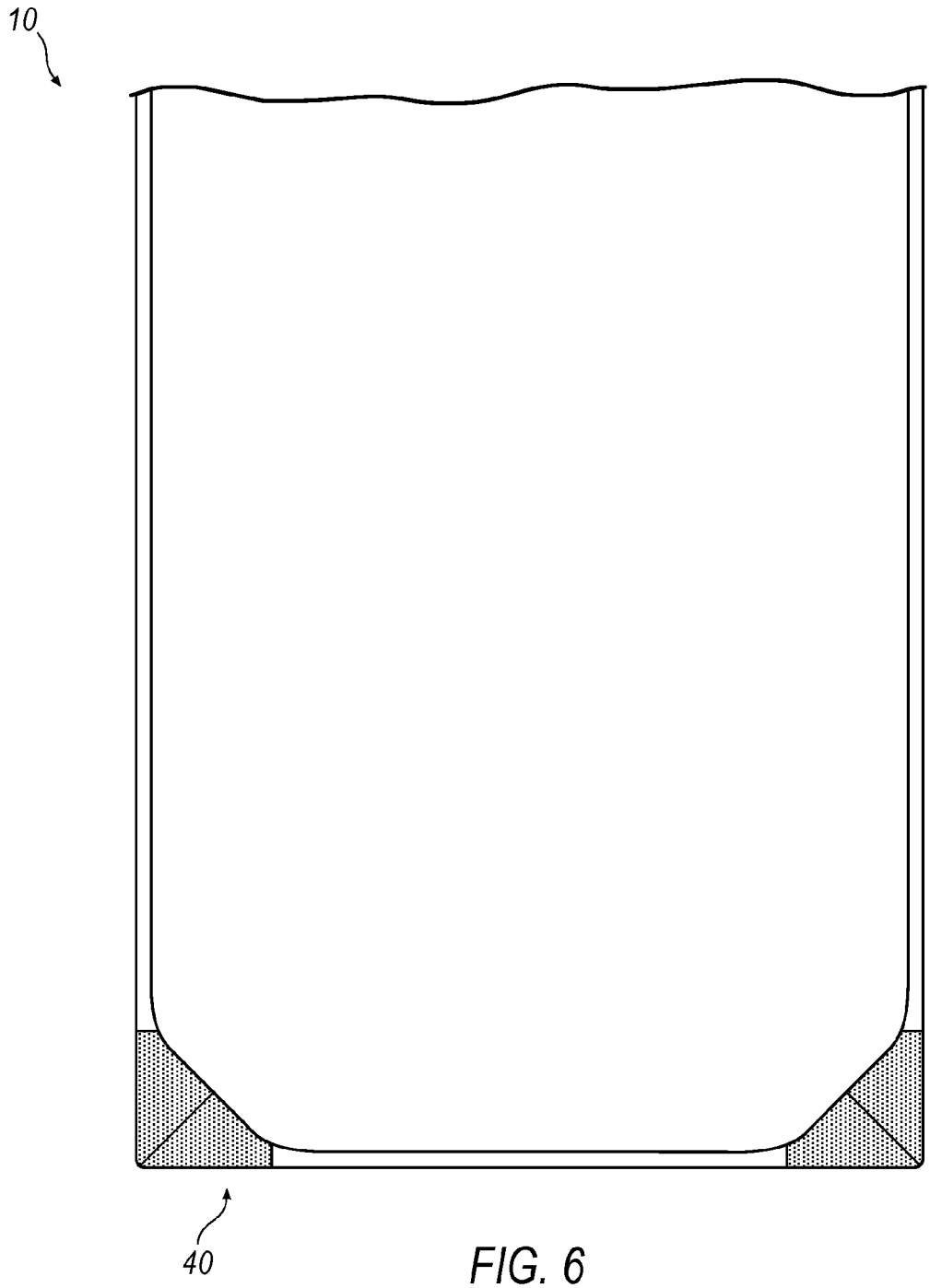
FIG. 6 is a partial bottom view of an exemplary fitted sheet.

Referring back to FIG. 1, the stretchable portions 22 may extend downwardly from the top panel 12 an extent "t." However, as illustrated in FIG. 6, the stretchable portions 22 may potentially extend to an underside of the mattress opposing the top panel 12, and extending beyond an extent "t" in dimension when in a loaded orientation fitted about mattress. That is, the stretchable portions 22 may extend underneath the mattress and may form a box corner configuration 40. The box corner configuration 40 may allow the sheet to conform to the contours of mattresses of various thickness. FIG. 6 also illustrates the plurality of side panels 14, 16, 18, 20 extending to the underside of the mattress. However, the fitted sheet 10 may be designed such that only the stretchable portions 22 extend to the underside of the mattress.

As illustrated, the stretchable portions 22 are substantially square although the dimensions can vary for the reasons noted above. Thus, although illustrated as substantially square, the stretchable portion 22 may take on any suitable shape. For example, in another exemplary fitted sheet, a single stretchable portion 22 may be disposed between the second end 26 of the first side panel 14 and the first end 28 of the second side panel 16. Thus, the stretchable portion 22 may be substantially rectangular or triangular allowing a single stretchable portion 22 to be used to extend around a corner of the mattress.

In an approach where opposing side panels 14, 18 are substantially congruent and opposing side panels 16, 20 are substantially congruent, when the stretchable portions 22 are generally of the same size and shape, the elastic nature of the stretchable portions 22 are at least generally equalized. Therefore, when the stretchable portions are mated, the sheet is centered about each corner to promote its correct positioning. In some approaches the stretchable portion 22 for the longer side panels 16, 20 with extent "l" may be slightly less than the stretchable portion 22 for the shorter side panels 14, 18 to take into account the natural elasticity of the material itself so as to assure correct centering of the fitted sheet 10 about each corner of the mattress. To promote a generally constant spring constant between the plurality of side panels 14, 16, 18, 20 the spring constant of the stretchable portions 22 may also be adjusted as necessary rather than adjusting the extent of each panel. In some situations both the extent of each stretchable panel and its spring constant may be adjusted.

Figure 7:
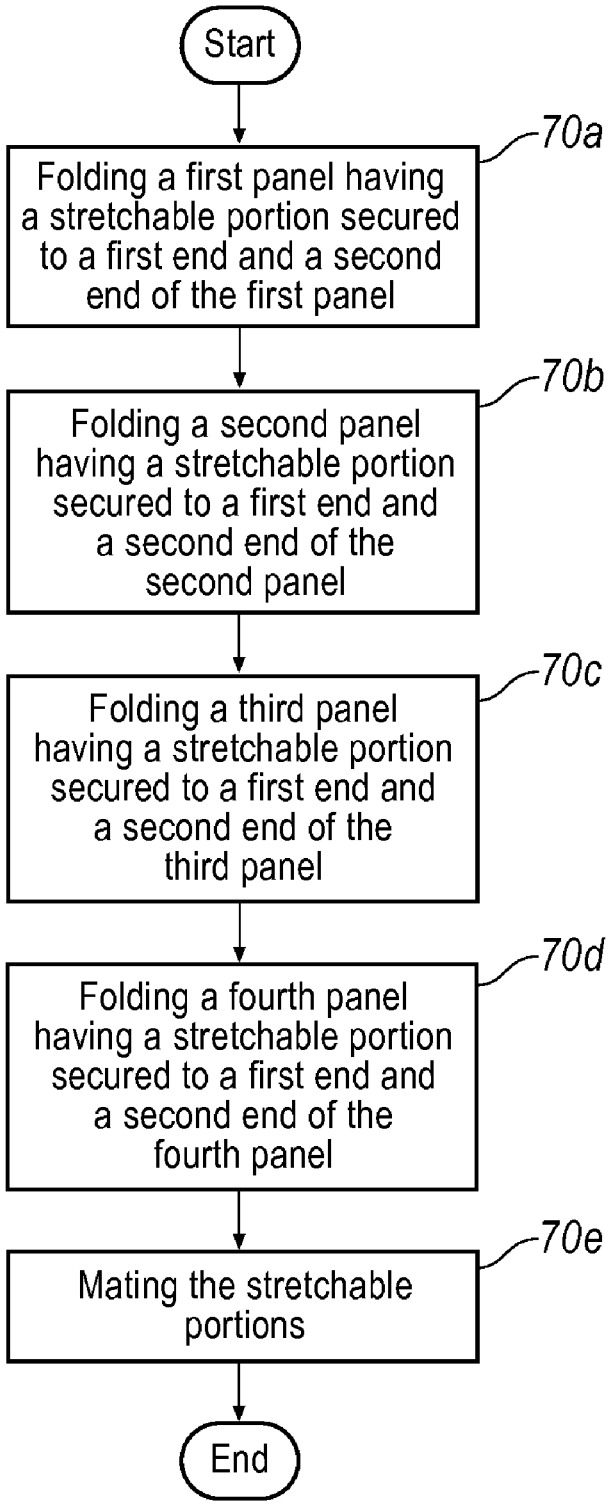
FIG. 7 is a method of forming the exemplary fitted sheet.

As previously discussed, the use of the stretchable portion 22 formed from a LYCRA® infused cotton weave or other suitable material allows the fitted sheet 10 to stretch and conform to mattresses of varying depths. That is, the same fitted sheet 10 may conform to mattresses ranging from standard sizes to premium pillow top sizes. In that respect, the portion of each stretchable portion 22 may have a spring constant different along the dimension corresponding to the thickness of the mattress as opposed to the dimension helping to define the overall extent of side panel 14, 16, 18, 20. In other situations, the spring constant may be at least generally the same for both dimensions. The mated stretchable portions 22 also creates a better fit, in that, the elastic nature of the stretchable portion 22 secures the fitted sheet 10 to the mattress creating less wrinkles. The mated stretchable portions 22 also helps retain the sheet in its proper position during use. Moreover, the fitted sheet 10 may be easier to apply and remove from the mattress and may be easier to fold and store during nonuse An exemplary approach to forming the fitted sheet 10 is illustrated in FIG. 7. As previously discussed the top panel 12 and the plurality of side panels 14, 16, 18, 20 may be formed from a single piece of material. The material may be configured to be folded into fitted sheet 10, as illustrated in FIG. 1.

The plurality of side panels 14, 16, 18, 20 may be folded downwardly with respect to the top panel 12 to form the fitted sheet 10. The plurality of side panels may be folded downwardly simultaneously or the side panels may be folded downwardly individually, as illustrated in **70*a*-70*d*. The stretchable portions 22 may be joined to the end, edges, or corners of the plurality of side panels 14, 16, 18, 20** prior to folding the material or after the material has been folded.

When the first side panel 14 and the second side panel 16 are folded downwardly, the stretchable portion 22 secured to the second end 26 of the first panel 14 and the stretchable portion 22 secured to the first end 28 of the second side panel 16. Similarly, the stretchable portion 22 secured to the second end 30 of the second side panel 16 and the stretchable portion 22 secured to the first end 32 of the third side panel 18 abut when the second side panel 16 and the third side panel 18 are folded. The stretchable portion 22 secured to the second end 34 of the third side panel 18 and the stretchable portion 22 secured to the first end 36 of the fourth side panel 20 also abut when the third side panel 18 and the fourth side panel 20 are folded. Finally, the stretchable portion 20 secured to the second end 38 of the fourth side panel 20 and the stretchable portion 22 secured to the first end 24 of the first side panel 14 abut when the fourth side panel 20 and the first side panel 14 are folded. The abutting edges of stretchable portions 22 may be mated together using any suitable technique, including the five thread stitching technique discussed above. All of the abutting edges may be mated together simultaneously or the abutting corners may be mated individually forming each corner of the fitted sheet 10 separately, as illustrated in 70*e*.

When the abutting edges of stretchable portions 22 are mated the stretchable portions 22 may form a substantially rectangular mated stretchable portions 18 configured to extend around the corner of a mattress. Thus the formed fitted sheet 10 is capable of staying contoured to the mattress while in use and is capable of fitting mattresses of varying thickness.

Although the stretchable portions 22 are illustrated as being viewable, in other exemplary fitted sheets, the stretchable portions 22 may be covered by any suitable material including the material used to form the top panel 12 and the plurality of side panels 14, 16, 18, 20. In one exemplary approach, the side panels 14, 16, 18, 20 may be dimensioned such that a portion of the side panels may fold over the stretchable portions 22 at least partially concealing the stretchable portions 22.

Although discussed above with respect to a fitted sheet, this disclosure may pertain to any form of fitted linen configured to conform to the contours of a mattress.

What is claimed is:

1. A bedding product comprising:

a substantially rectangular top panel having a peripheral edge;

a first side panel extending from the top panel, the first panel having a first end and a second end;

a second side panel extending from the top panel, the second side panel having a first end and a second end;

a first stretchable portion secured to and extending downwardly from the peripheral edge of the top panel and joined to the second end of the first panel; and a second stretchable portion secured to and extending downwardly from the peripheral edge of the top panel and joined to the first end of the second panel, wherein the first stretchable portion joined to the second end of the first panel and the second stretchable portion joined to the first end of the second panel are mated together to form a corner, and wherein the elasticity of the first stretchable portion and the elasticity of the second stretchable portion is adjustable to accommodate side panels of varying dimensions.

2. The bedding product of claim 1 wherein the stretchable portion extends along a third extent measured from the peripheral edge of the top panel, the third extent representing a thickness of a mattress.

3. The bedding product of claim 1 wherein the top panel is comprised of a single material.

4. The bedding product of claim 1, wherein at least one of the stretchable portions extends underneath the corner of a mattress.

5. The bedding product of claim 1, wherein the mated portion of the first stretchable portion and the second stretchable includes five thread stitching.

6. The bedding product of claim 1, wherein the first stretchable portion joined to the second end of the first panel and the stretchable portion joined to the first end of the second panel are of the same elasticity in the direction of an extent representing the thickness of a mattress.

7. The bedding product of claim 1, wherein the first panel extends along a first extent representing a width dimension of a mattress.

8. The bedding produce of claim 1, wherein the second panel extends along a second extent representing a length dimension of a mattress.

9. The bedding product of claim 1, wherein the at least one stretchable portion is formed from one of LYCRA®, spandex yarn, and cotton yarn.

10. The bedding product of claim 1, wherein the at least one stretchable portion is formed from a LYCRA® infused cotton weave.

11. The bedding product of claim 1, further comprising a third side panel extending from the top panel.

12. The bedding product of claim 11, wherein the third side panel and the first side panel are substantially congruent.

13. The bedding product of claim 1, further comprising a fourth side panel extending from the top panel.

14. The bedding product of claim 13, wherein the second side panel and the fourth side panel are substantially congruent.

15. A method for forming a bedding product comprising:

joining a stretchable portion secured to and extending downwardly from a peripheral edge of a top panel to each of a first end and a second end of a first panel;

joining a stretchable portion secured to and extending downwardly from a peripheral edge of the top panel to each of a first end and a second end of a second panel;

joining a stretchable portion secured to and extending downwardly from a peripheral edge of the top panel to each of a first end and a second end of a third panel;

joining a stretchable portion secured to and extending downwardly from the peripheral edge of the top panel to each of a first end and a second end of a fourth panel;

folding the first panel, second panel, third panel, and fourth panel downwardly with respect to a top panel;

mating the stretchable portion joined to the second end of the first panel to the stretchable portion joined to the first end of the second panel to form a corner;

mating the stretchable portion joined to the second end of the second panel to the stretchable portion joined to the first end of the third panel to form a corner;

mating the stretchable portion joined to the second end of the third panel to the stretchable portion joined to the first end of the fourth panel to form a corner; and mating the stretchable portion joined to the second end of the fourth panel to the stretchable portion joined to the first end of the first panel to form a corner.

16. The method of claim 15 further comprising mating the stretchable portion joined to the second end of the first panel to the stretchable portion joined to the first end of the second panel using a five thread stitching technique.

17. A bedding product comprising:

a substantially rectangular top panel having a peripheral edge;

a first side panel extending from the top panel, the first panel having a first end and a second end;

a second side panel extending from the top panel, the second side panel having a first end and a second end;

a third side panel extending from the top panel, the third side panel having a first end and a second end;

a fourth side panel extending from the top panel, the fourth side panel having a first end and a second end; and a substantially square stretchable portion mated to the peripheral edge of the top panel, wherein the stretchable portion extends downwardly from the peripheral edge of the top panel and is joined to the first end and the second end of the first panel, the second panel, the third panel, and the fourth panel, wherein the top panel, the side panels, and the stretchable portions are configured to conform to multiple mattress depths, wherein the stretchable portion joined to the second end of the second panel is mated to the stretchable portion joined to the first end of the third panel to form a corner.

18. The bedding product of claim 17, wherein the stretchable portion joined to the second end of the third panel is mated to the stretchable portion joined to the first end of the fourth panel to form a corner.

19. The bedding product of claim 17, wherein the stretchable portion joined to the second end of the fourth panel is mated to the stretchable portion joined to the first end of the first panel to form a corner.

20. A bedding product comprising:

a substantially rectangular top panel having a peripheral edge;

a first side panel extending from the top panel, the first panel having a first end and a second end;

a second side panel extending from the top panel, the second side panel having a first end and a second end;

a third side panel extending from the top panel, the third side panel having a first end and a second end;

a fourth side panel extending from the top panel, the fourth side panel having a first end and a second end; and a substantially square stretchable portion mated to the peripheral edge of the top panel, wherein the stretchable portion extends downwardly from the peripheral edge of the top panel and is joined to the first end and the second end of the first panel, the second panel, the third panel, and the fourth panel, wherein the top panel, the side panels, and the stretchable portions are configured to conform to multiple mattress depths, wherein the stretchable portion joined to the second end of the first panel is mated to the stretchable portion joined to the first end of the second panel to form a corner.

* * * * *